United States Patent [19]

Nawa et al.

[11] 4,327,869

[45] * May 4, 1982

[54] FLUID DEFLECTING ASSEMBLY

[75] Inventors: Motoyuki Nawa; Norio Sugawara; Yutaka Takahashi, all of Nara, Japan

[73] Assignee: Matsushita Electric Industrial Co., Ltd., Kadoma, Japan

[ * ] Notice: The portion of the term of this patent subsequent to May 12, 1998, has been disclaimed.

[21] Appl. No.: 165,939

[22] Filed: Jul. 3, 1980

[30] Foreign Application Priority Data

Jul. 12, 1979 [JP] Japan ..... 54-94492
Jul. 24, 1979 [JP] Japan ..... 54-94492

[51] Int. Cl.[3] ..... B05B 1/04

[52] U.S. Cl. ..... 239/590.5; 239/DIG. 7; 60/230; 98/40 N

[58] Field of Search ..... 239/590.5, DIG. 7; 60/35.54; 137/829; 98/40 R, 40 V, 40 N

[56] References Cited

U.S. PATENT DOCUMENTS

| | | | |
|---|---|---|---|
| 2,684,690 | 7/1954 | Lee | 98/40 V |
| 2,702,986 | 3/1955 | Kadosch et al. | 60/35.54 |
| 2,812,980 | 11/1957 | Kadosch et al. | 239/DIG. 7 |
| 3,102,389 | 9/1963 | Pedersen et al. | 60/35.54 |
| 3,597,166 | 8/1971 | Hochkman | 239/590.5 |
| 3,621,859 | 11/1971 | Scott | 137/829 |
| 3,642,093 | 2/1972 | Schach | 98/40 R |
| 3,998,393 | 12/1976 | Petty | 239/590.5 |
| 4,141,507 | 2/1979 | Rump | 239/590.5 |
| 4,146,357 | 3/1979 | Ward et al. | 239/DIG. 7 |

*Primary Examiner*—Henry C. Yuen
*Attorney, Agent, or Firm*—Wenderoth, Lind & Ponack

[57] ABSTRACT

A fluid deflecting assembly is constituted by first and the second walls, the former having a curved portion to cause the adherence of the outlet flow and the latter having a substantially straight portion to cause the adherence of the outlet flow and having a ridge at its upstream end and a control vane rotatably positioned within a passage formed by the first and the second walls. The control vane is able to rotate around a shaft thereby causing wide deflection of the outlet flow due to the existence of the two walls. The height and position of the ridge is such as to help the vertical downward deflection of the outlet flow along the curved portion. The length and position of the straight portion is such as to help the horizontal deflection of the outlet flow along the straight portion.

5 Claims, 13 Drawing Figures

FLUID DEFLECTING ASSEMBLY

BACKGROUND OF THE INVENTION

The present invention generally relates to a fluid deflecting assembly which is able to deflect air flow widely and continuously using a control vane. In this invention, the air flow is deflected from a horizontal to a vertical downward direction using the so called Coanda effect which causes the flow to adhere to a wall. For the downward deflection, a curved wall is used and for the horizontal, a substantially straight wall is used.

With this assembly it is possible to attain not only wide deflection of the flow but also two widely divided flows, one of which is directed in a downward direction and the other directed in a horizontal direction by using two walls at the same time. With this assembly, the user can select several flow patterns according to the inclination of a control vane.

A previously developed deflecting assembly is shown in U.S. Ser. No. 931,282, filed on Aug. 4, 1978, now U.S. Pat. No. 4,266,722. In this case, the directing means, which is constituted by an L-shaped beam is employed in the upper part of the fluid deflecting assembly and located downstream of a deflecting blade. Furthermore, there is no attachment wall having a straight portion downstream of the directing means. Accordingly, horizontal air flow is rather difficult to attain and moreover, a flow pattern having two divided flows cannot be realized.

The same thing is also true for U.S. Pat. No. 2,812,980, patented on Nov. 12, 1957, although there is no such control means as the deflecting blade employed in the present invention.

SUMMARY OF THE INVENTION

The object of this invention is to deflect an air flow widely and continuously from a horizontal to a vertical downward direction.

Another object of the present invention is to use a straight wall as an adherence wall to insure the deflecting in a horizontal direction.

A further object of the present invention is to divide the air flow into two widely divergent flows using two walls as the adhering walls at the same time.

A still further object of the present invention is to decrease the flow rate loss by providing a ridge upstream of the downstream end of a control vane.

A still further object of the present invention is to provide a setback in order to insure the deflecting operation in a horizontal direction without causing adherence to the curved guide wall.

A still further object of the present invention is to increase the deflecting angle by using a curved control vane.

A still further object of the present invention is to increase the deflecting angle by using a control vane having a bend at its downstream end.

A still further object of the present invention is to obtain a flow pattern of divided two flows using a control vane having a curved cross-section with an outer surface having a smaller radius of curvature than that of the inner surface.

DETAILED DESCRIPTION OF THE INVENTION

Figure 1:
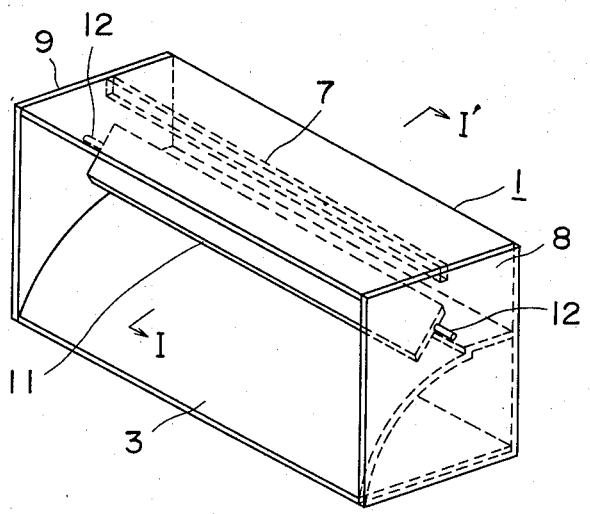
FIG. 1 is a perspective view of a fluid deflecting assembly according to one preferred embodiment of the present invention.

Before the description of the present invention proceeds, it is to be noted that like parts are designated by like reference numerals throughout the accompanying drawings. It is also to be noted that, although the term "fluid" hereinbefore and hereinafter referred to as a driving fluid by which the fluid deflecting assembly of the present invention operates, is intended to include gas and liquid, the following detailed description will be made with air as the driving fluid for facilitating a better understanding of the present invention.

Figure 2:
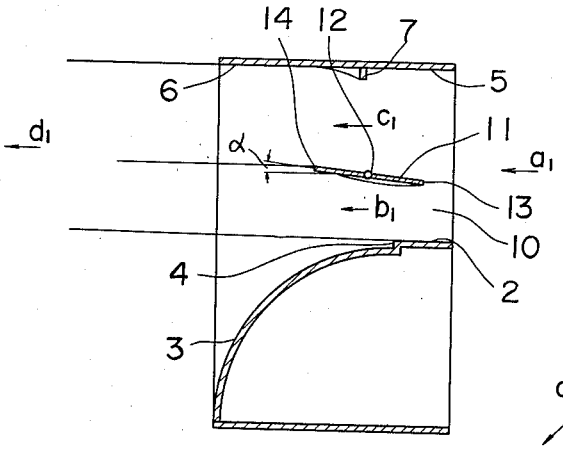
FIGS. 2(*a*)–2(*d*) are cross-sectional views of the fluid deflecting assembly, taken along the line I—I' in FIG. 1, showing the flow patterns with the control vane positioned at different operative positions.
Figure 2:
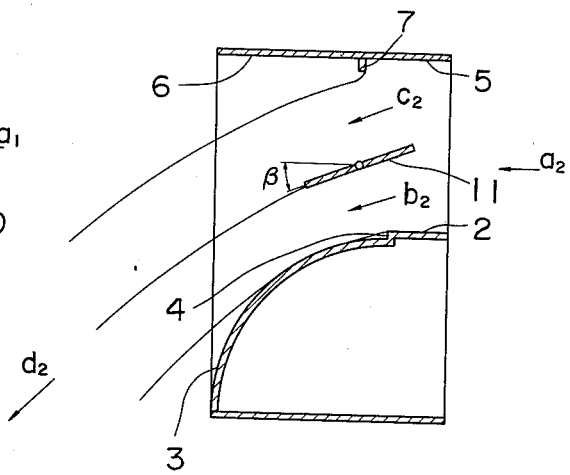
Figure 2:
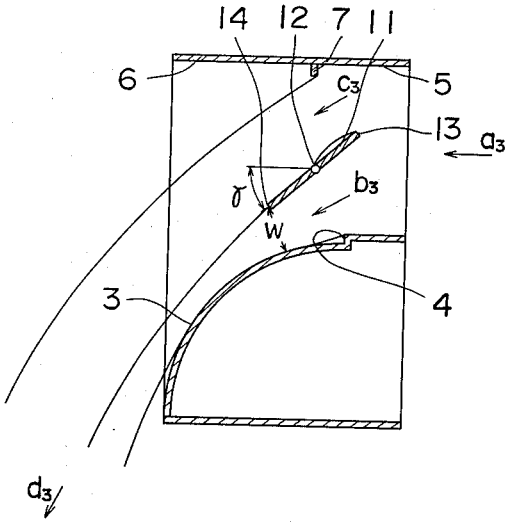
Figure 2:
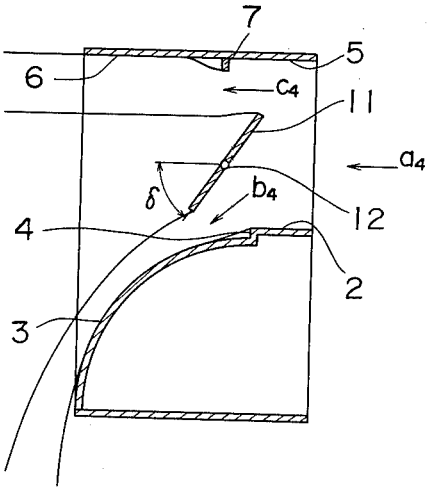

Referring now to FIGS. 1 and 2(*a*)–2(*d*), a fluid deflecting assembly according to the present invention, generally indicated by 1, comprises a lower upstream wall 2 followed by a lower curved guide wall 3 with a setback 4 at the upstream end between it and the upstream wall 2, and an upper upstream wall 5 followed by a substantially straight guide wall with a ridge 7 at its upstream end.

The fluid deflecting assembly 1 has side panels 8 and 9. The lower upstream wall 2 and the guide wall 3 and the upper upstream wall 5 and the straight guide wall 6 are attached to side panels 8 and 9 as shown in FIG. 1 in any known manner, and together define a fluid passage or duct 10 in the fluid deflecting assembly 1. A flat control vane is designated by 11; and extends between the side panels 8 and 9 crossing the fluid passage 10. This control vane 11 is carried by a shaft 12 having its opposite ends journalled on the side panels 8 and 9; and is positioned immediately above the setback 4. Although not shown, one end of the shaft 12 is in turn coupled through a suitable transmission system to a drive mechanism, such as one or both of a manipulatable switching knob and an electrically operated motor, so that the control vane 11 can be pivoted about the shaft 12, either adjustably or continuously, depending upon the type of drive mechanism.

The control vane 11 divides the flow passing through the passage 10 into two flows, one of which is a lower flow (the first flow) between the curved guide wall 3 and the control vane 11 and the other is an upper flow (the second flow) between the straight guide wall 6 and the control vane 11.

The ridge 7 is positioned and has a height for deflecting the upper flow downward when the outlet flow is aimed in a vertically downward direction but does not prevent the upper flow from adhering to the straight guide wall 6 when the outlet flow is aimed in the horizontal direction. The length of the straight guide wall 6 is also sufficient for the upper flow to adhere thereto when the upper flow is directed in a horizontal direction. Accordingly, the ridge 7 is located upstream of the downstream end 14 of the control vane 11. Due to this location of the ridge 7, the height of the ridge 7 is smaller than the conventional directing means as is shown in the above described U.S. application Ser. No. 931,282, filed on Aug. 4, 1978.

The lower upstream wall 2 is substantially parallel to a tangent to the upstream end of the curved guide wall 3 in order to cause the lower flow to be deflected easily toward the curved guide wall 3.

The setback 4 is provided to prevent the lower flow from adhering to the curved guide wall 3 when the outlet flow is aimed in the horizontal direction.

In FIG. 2(*a*), the control vane 11 is inclined a little in an upward direction to an angle, $\alpha$. In this condition, the upper flow, $c_1$, is directed in a slightly downward direction because of the existence of the ridge 7; however, it adheres to the straight guide wall 6 due to the interaction between the upper flow, $c_1$, and the straight guide wall 6 in addition to the influence of the inclination of the control vane 11. In this case, the inclination angle of the control vane, $\alpha$, is less than that in the case of the directing means, which is intended to act in the same way as the ridge 7, located downstream of the downstream end of the control vane 11 in the previously disclosed structure. On the other hand, the lower flow, $b_1$, separates from and then adheres to the control vane 11 and is directed in a horizontal direction without any adherence to the curved guide wall 3 due to the existence of the setback 4. As a consequence, the outlet flow, $d_1$, is directed in a horizontal direction.

In FIG. 2(*b*), the control vane 11 is inclined a little in the downward direction as designated by an angle $\beta$. In this case, the lower flow, $b_2$, is directed in an oblique direction due to the inclination of the control vane 11 and adheres to the curved guide wall 3. However, the lower flow, $b_2$, separates from the curved guide wall 3 after adhering to only a portion of the curved guide wall 3, because the inclination angle, $\beta$, is small. On the other hand, the upper flow, $c_2$, is directed in a slightly downward direction by the influence of the ridge 7. There is no tendency for the upper flow to be directed in an upward direction by the blade, and therefore the upper flow does not adhere to the straight guide wall 6, but flows along the control vane 11. Accordingly, the outlet flow is directed in an oblique direction.

In FIG. 2(*c*), the control vane 11 is inclined to a large degree in an oblique direction as designated by an angle $\gamma$. The lower flow, $b_3$, adheres almost to the end of the curved guide wall 3 due to the large inclination of the control vane 11 and the nozzle width, w, which is smaller than that in the case of FIG. 2(*b*). It is to be noted that the deflection angle generally increases according to a decrease of the jet width (nozzle width) when the jet attaches to the curved wall. On the other hand, the upper flow, $c_3$, is directed in a downward direction as shown in FIG. 2(*b*), and flows along the control vane 11, being induced by the lower flow, $b_2$. Accordingly, the outlet flow is directed in a downward direction.

In FIG. 2(*d*), the control vane 11 is inclined still further in a downward direction as designated by an angle $\delta$. Although the lower flow, $b_4$, attaches to the curved guide wall 3, as shown in FIG. 2(*c*), the upper flow, $c_4$, cannot be induced by the lower flow, $b_4$, because the large inclination of the control vane 11 increases the distance between the two flows, $b_4$ and $c_4$ and the small momentum of the lower flow, $b_4$, is not enough to exert the inducing effect on the upper flow, $c_4$. Therefore, the upper flow, $c_4$, adheres to the straight guide wall 6, in spite of the existence of the ridge 7. Accordingly, the outlet flow is divided into two flows which are widely separated from each other.

As stated before, the lower upstream wall 2 is directed in the same direction as a tangential to the upstream end of the curved guide wall 3, and therefore, the adherence of the lower flow to the curved guide wall 3 is easily caused. Namely, there is no need for the upper flow to press against the lower flow in order to intensify the adherence of the lower flow to the curved guide wall 3. As a consequence, the height of the ridge 7 can be rather small, which means that the flow resistance of the ridge 7 is small.

As shown in FIG. 2(*a*), the ridge 7 should be located upstream of the downstream end 14 of the control vane 11. That is to say, in order to attain the adherence of the upper flow to the straight guide wall 6, the directional restriction of the control vane 11 should be effected downstream of the ridge 7. This location of the ridge 7 does not necessarily weaken the deflecting effect of the ridge 7 on the upper flow when the vane is positioned as FIG. 2(*b*) or 2(*c*), because the role of the ridge 7 is merely to deflect the upper flow to cause it to flow along the control vane 11. Furthermore, the deflecting effect of the ridge 7 at this upstream position is much larger than when it is in a downstream position.

As mentioned above, the present invention makes it possible to attain wide and continuous deflection of the outlet flow, as well as a flow pattern divided into two flows, by merely changing the inclination angle of the control vane 11.

Due to the continuous shift of the detachment point according to the control vane rotation, the outlet flow can be deflected continuously in any desired direction.

Figure 3A:
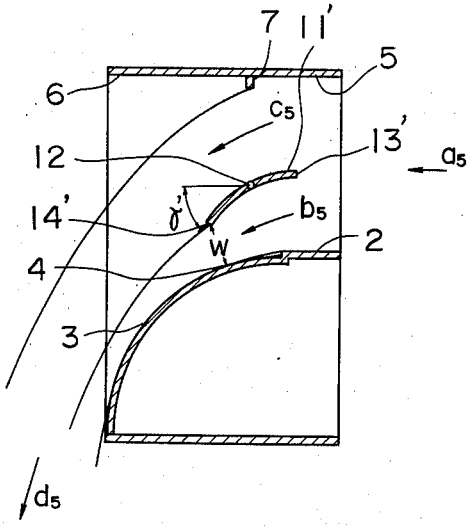
FIGS. 3(*a*) and 3(*b*) are schematic sectional views of a further embodiment of the fluid deflecting assembly with the control vane positioned at different operative positions.
Figure 3B:
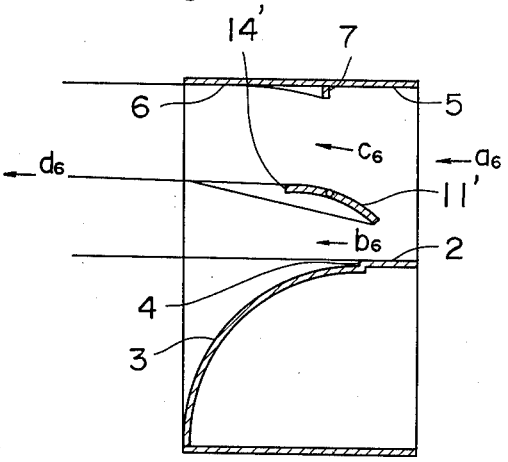

Fluid deflecting assemblies wherein various shaped control vanes such as indicated by 11 in the foregoing embodiment are employed, is illustrated in FIGS. 3(*a*) to 6(*c*), which will now be described.

In FIGS. 3(*a*) and 3(*b*) a control vane 11' is employed instead of the control vane 11 as shown in FIG. 1. The upstream and downstream ends of the control vane 11' are designated by 13' and 14' respectively. This embodiment is designed so as to attain a preferred operation in deflecting the outlet flow in a downward direction.

In FIG. 3(*a*), the inclination of the control vane 11' represented by the line drawn from the shaft 12 to the downstream end 14' of the control vane 11' is defined by an angle $\gamma'$ relative to the horizontal line. When $\gamma=\gamma'$, the lower flow, $b_5$, is directed in a more downward direction, compared with the lower flow, $b_4$, in the case of FIG. 2(*c*), because of the curvature of the control vane 11'. Therefore, the lower flow, $b_5$, remains adhered to a position further downstream along the curved guide wall 3, compared with the case of using the flat control vane 11 shown in FIG. 2(*c*). On the other hand, the upper flow, $c_5$, changes its direction smoothly and easily because of the curvature of the control vane 11'. Accordingly, the outlet flow, $d_5$, is directed in a more downward direction in comparison with the flat shape control vane 11. Furthermore, the curvature of the control vane 11' contributes to a decrease in the flow resistance due to the fact that both flows $b_5$ and $c_5$ undergo the directional change gradually, compared with the case of using a flat shape control vale 11.

In FIG. 3(*b*), the upper flow, $c_6$, flows along the curved surface of the control vane 11' and tends to flow in a slightly downward direction at the downstream end 14' of the control vane 11'. However, in this case, the upper flow, $c_6$, interacts with and adheres to the straight guide wall 6 rather than joining with the lower flow, $b_6$, thereby producing a horizontally directed outlet flow, $d_6$.

Thus, this structure makes it possible to attain a wider angle of deflection of the outlet flow, from the horizontal to the vertical downward direction, with less flow resistance by using the curved control vane 11'.

Figure 4:
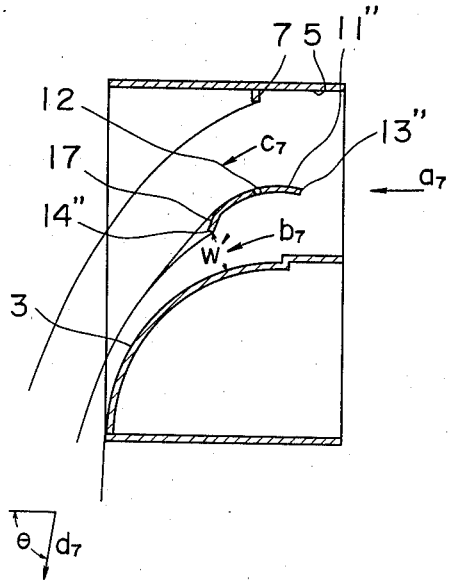
FIGS. 4(*a*) and 4(*b*) are schematic sectional views of a further embodiment of the fluid deflecting assembly with the control vane positioned at different operative positions.
Figure 4:
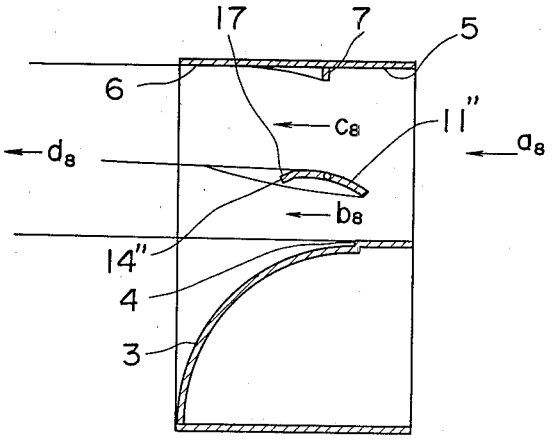

In FIGS. 4(*a*) and 4(*b*) a curved control vane 11' having a bend 17 at its downstream end, is employed instead of the curved control vane 11' shown in FIGS. 3(*a*) and 3(*b*). The upstream and downstream ends of the control vane 11'' are designated by 13'' and 14'' respectively. This embodiment is also designed so as to achieve a preferred operation in deflecting the outlet flow in a downward direction.

In FIG. 4(*a*), the lower flow, $b_7$, is directed in a further downward direction by the effect of the bend 17. Furthermore, the nozzle width w' is decreased by the existence of the bend 17, compared with the case of FIG. 3(*a*), wherein no bend is employed. Due to above described two conditions, the adherence continues further downstream along the curved guide wall 3. Although the upper flow, $c_7$, separates from the control vane 11''at the beginning of the bend 17, it is induced by the firmly attached lower flow, $b_7$. Accordingly, the outlet flow, $d_7$, is deflected in a further downward direction than in the case of using the control vane without a bend.

In FIG. 4(*b*), the upper flow, $c_8$, flows along the curvature of the control vane 11'', and separates easily from the surface of the control vane 11'' due to the existence of the bend 14''. Therefore, the adherence of the upper flow, $c_8$, to the straight guide wall occurs more easily in this case than in that of FIG. 3, wherein no bend is employed. The lower flow, $b_8$, is induced by the upper flow, $c_8$, thereby providing a horizontally directed outlet flow, $d_8$.

As stated above, it is possible to attain a greater angle of deflection of the outlet flow in comparison with the case of FIGS. 3(*a*) and 3(*b*).

Figure 5:
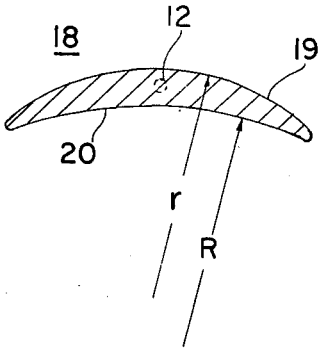
FIG. 5 is a side sectional view of a control vane for the fluid deflecting assembly according to a further preferred embodiment of the present invention.
Figure 6:
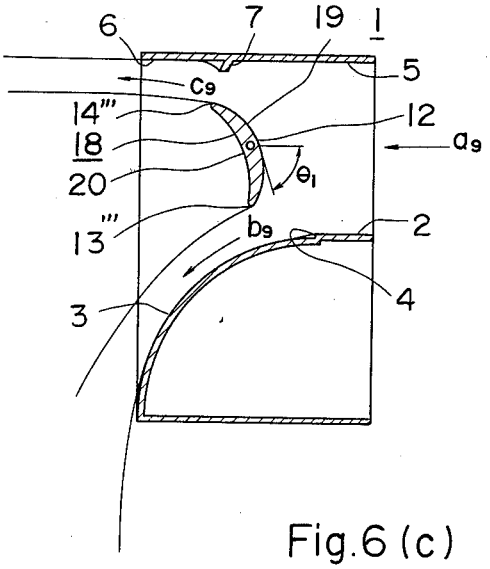
FIGS. 6(*a*)–6(*c*)are schematic sectional views of the fluid deflecting assembly employing the control vane shown in FIG. 5 with the control vane positioned at different operative positions.
Figure 6:
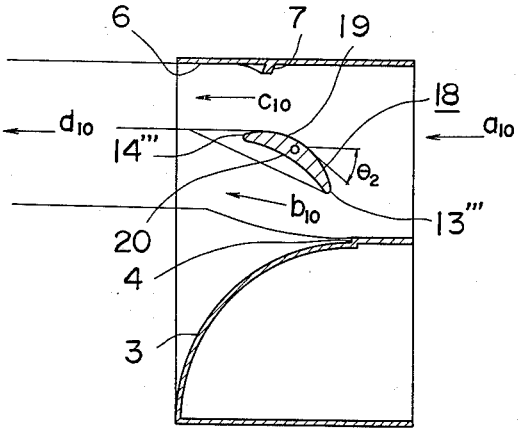
Figure 6:
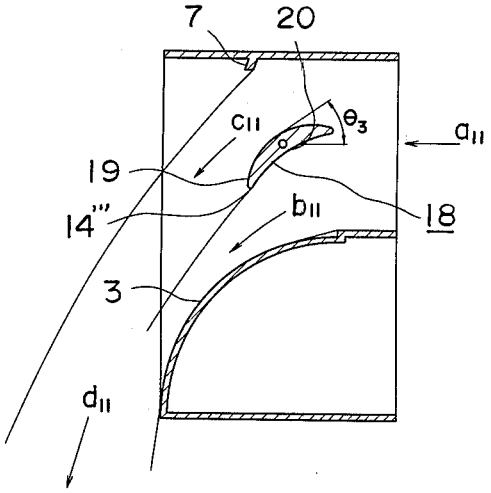

Referring to FIGS. 5 and 6(*a*)–6(*c*), a control vane 18 has a thickness in its cross-section which is defined by an outer radius, r, and an inner radius, R, the former being that for an outer surface 19 and the latter being that for an inner surface 20, as shown in FIG. 5. The radius r is such as not only to minimize the flow resistance in producing the flow pattern shown in FIG. 6(*a*), but also to prevent the upper flow from separating from the outer surface 19 of the control vane 18 in producing the flow pattern shown in FIG. 6(*c*). The radius R is such as not only to deflect the lower flow smoothly in producing the flow pattern shown in FIG. 6(*c*), but also to cause a negative pressure easily in the region between the lower flow and the control vane 18 in producing the flow pattern shown in FIG. 6(*b*).

In FIG. 6(*a*), the control vane 18 is inclined upward at a large angle of $\theta$, relative to the horizontal direction, thereby splitting the inlet flow, $a_9$, into two flows, $b_9$, and $c_9$. The lower flow, $b_9$, is directed along the lower part of the outer surface 19 of the control vane 18 and adheres to the curved guide wall 3 as shown in FIG. 6(*a*). On the other hand, the upper flow, $c_9$, is directed along the upper part of the outer surface 19 of the control vane 18 and adheres to the straight guide wall 6 as shown in FIG. 6(*a*) because the downstream end 14''' of the control vane 18 is located downstream of the ridge 7. Thus, the inlet flow, $a_9$, is divided into two flows widely separated from each other.

In FIG. 6(*b*), the inclination angle is decreased to $\theta_2$, for producing a horizontally directed outlet flow. The upper flow, $c_{10}$, flows along the outer surface 19 and adheres to the straight guide wall 6, because the ridge 7 is located upstream of the downstream end 13''' of the control vane 18. On the other hand, the lower flow, $b_{10}$, separates at the upstream end 13''' of the control vane 18 and joins the upper flow, $c_{10}$, with the help of negative pressure caused in the region between the lower flow, $b_{10}$, and the inner surface 20 of the control vane 18. Accordingly, the outlet flow, $d_{10}$, is directed in a horizontal direction.

In FIG. 6(*c*), the control vane 18 is inclined in an oblique downward direction at an angle of $\theta_3$ relative to the horizontal direction for the purpose of deflecting the outlet flow in a vertical downward direction. The lower flow, $b_{11}$, flows along the inner surface 20 of the control vane 18, gradually changing its direction, thereby maintaining the adherence to the curved guide wall 3 to its downstream end. On the other hand, the upper flow, $c_{11}$, flows along the outer surface 19 of the control vane 18 with the aid of the deflection effect caused by the ridge 7, which is located upstream of the downstream end 14''' of the control vane 18. Accordingly, the outlet flow, $d_{11}$, is directed in a vertically downward direction.

As described hereinbefore, it is possible to attain a flow pattern divided into two flows with less flow resistance by using a control vane having different values for the radii of its outer and inner surfaces without influencing the wide deflection of the outlet flow from the horizontal to the downward direction.

It is to be noted that, in the case of FIGS. 2(*a*)–2(*d*), the flow pattern with divided flows is achieved after the downward deflecting flow pattern as shown in FIG. 2(*c*), by turning the shaft 12 in a counterclockwise direction. In constrast thereto, in the case of FIGS. 6(*a*)–6(*c*), the flow pattern with divided flows is achieved after the horizontally deflected flow pattern as shown in FIG. 6(*b*), by turning the shaft 12 in a clockwise direction.

While the invention has been particularly shown and described with reference to several specific embodiments, it will be clear that various modifications can be made in construction and arrangement within the scope of the invention as defined in the appended claims.

What is claimed is:

1. A fluid deflecting assembly which comprises:

a fluid duct having supply and exit openings defined at respective ends of said fluid duct and through which a fluid medium flows from the supply opening towards the exit openings;

a first guide wall structure along one side of said duct and having an outwardly diverging curved downstream wall portion adjacent the exit opening, said outwardly diverging curved wall area having an upstream edge with the surface extending substantially parallel to the axial direction of said duct between the supply and the exit openings and said curved downstream wall area being curved for diverging outwards in a direction downstream with respect to the direction of flow of the fluid medium in said duct, a setback at said upstream edge extending toward the center of said duct, and a straight upstream portion connected to said setback and extending parallel to said axial direction;

a second guide wall structure along the opposite side of said duct and having a straight upstream wall portion, a ridge at the downstream end of said straight upstream wall portion, and a straight downstream wall portion extending downstream of said duct from said ridge and in alignment with said straight upstream wall portion, said straight upstream wall portion and straight downstream wall portion extending parallel to said axial direction and said straight downstream wall portion extending sufficiently far in the downstream direction for causing a stream of fluid flowing therealong to adhere thereto; and a pivotally supported deflecting blade in said duct between said guide structures for deflecting the flow of the fluid medium flowing through the fluid duct and for dividing the flow of fluid medium into two components at all positions of said blade, said deflecting blade having the downstream edge thereof positioned downstream of said ridge and also downstream of said setback, said deflecting blade being movable between a first position in which it is substantially parallel to said axial direction for causing the components between said second guide wall structure and said deflecting blade and between said deflecting blade and said first guide wall structure to flow substantially parallel to said axial direction with the component between said deflecting blade and said second guide wall structure being deflected around said ridge and adhering to said straight downstream wall portion, whereby a single stream substantially parallel to the axial direction is formed, through intermediate positions in which the component between said deflecting blade and the first guide wall structure is deflected along and caused to adhere to said outwardly diverging curved downstream wall portion and the component between said deflecting blade and said second guide wall structure is deflected by said ridge for being joined with the component between said deflecting blade and said first guide wall structure, whereby a single diverted stream is formed, and a second position in which the component between the deflecting blade and the first guide wall structure is deflected along and caused to adhere to said outwardly diverging curved downstream wall portion and the component between said deflecting blade and said second guide wall structure is deflected by the deflecting blade around said ridge and along said straight downstream wall portion, whereby two separate fluid streams are formed, one flowing parallel to said axial direction and one diverted therefrom.

2. A fluid deflecting assembly as claimed in claim 1 in which said deflecting blade is a flat plate.

3. A fluid deflecting assembly as claimed in claim 1 in which said deflecting blade is a plate having a curved cross-section in the direction of flow of the fluid through said duct curved concavely toward said second guide wall structure.

4. A fluid deflecting assembly as claimed in claim 2 in which the downstream end of said blade has a portion bent toward said curved downstream wall portion.

5. A fluid deflecting assembly as claimed in claim 1 in which said duct is horizontal and said first guide wall structure is on the lower side of said duct and said second guide wall structure is on the upper side of said duct.

* * * * *